US009536397B2

(12) United States Patent
Tseng

(10) Patent No.: US 9,536,397 B2
(45) Date of Patent: Jan. 3, 2017

(54) PEEP DEVICE FOR POKER CARD GAME MACHINE

(71) Applicant: Tzu-Hsiang Tseng, Taichung (TW)

(72) Inventor: Tzu-Hsiang Tseng, Taichung (TW)

( * ) Notice: Subject to any disclaimer, the term of this patent is extended or adjusted under 35 U.S.C. 154(b) by 49 days.

(21) Appl. No.: 14/289,643

(22) Filed: May 28, 2014

(65) Prior Publication Data

US 2015/0348372 A1 Dec. 3, 2015

(51) Int. Cl.

| | |
|---|---|
| ***A63F 1/06*** | (2006.01) |
| ***A63F 1/02*** | (2006.01) |
| ***A63B 71/00*** | (2006.01) |
| ***G07F 17/32*** | (2006.01) |

(52) U.S. Cl.

CPC ..... *G07F 17/3293* (2013.01); *G07F 17/3202* (2013.01); *G07F 17/3211* (2013.01)

(58) Field of Classification Search

CPC ..... A63F 1/06; A63F 2009/0623

See application file for complete search history.

(56) References Cited

U.S. PATENT DOCUMENTS

| | | | | |
|---|---|---|---|---|
| 2009/0121428 | A1* | 5/2009 | Markov | 273/148 A |
| 2009/0322025 | A1* | 12/2009 | Blake | A63F 1/06 273/148 R |
| 2014/0346733 | A1* | 11/2014 | Shigeta et al. | 273/292 |

* cited by examiner

*Primary Examiner* — Dmitry Suhol
*Assistant Examiner* — Ankit Doshi
(74) *Attorney, Agent, or Firm* — Raymond Chan

(57) ABSTRACT

A peep device for a poker card game machine includes a box. The box is provided with first and second video cameras, circuit boards having light emitting diodes for fill-in light, and a reflector on top of the box. The reflector has first and second sight holes corresponding in position to the first and second video cameras. When a poker card slowly passes through the first and second sight holes and the first and second video cameras, the suit and the number of the poker card will be displayed slowly for the player to peep at the poker card with excitement. The light emitting diodes illuminate to shoot the poker card clearly.

4 Claims, 6 Drawing Sheets

PEEP DEVICE FOR POKER CARD GAME MACHINE

NOTICE OF COPYRIGHT

A portion of the disclosure of this patent document contains material which is subject to copyright protection. The copyright owner has no objection to any reproduction by anyone of the patent disclosure, as it appears in the United States Patent and Trademark Office patent files or records, but otherwise reserves all copyright rights whatsoever.

BACKGROUND OF THE PRESENT INVENTION

Field of Invention

The present invention relates to a peep device for a poker card game machine, more particularly to a peep device which is able to display the suit and the number of a poker card for the player to peep at the poker card with excitement.

Description of Related Arts

A conventional poker card game machine is provided with a video camera to shoot and display the suit and the number of a poker card. However, it has the following shortcomings:

1. The video camera shoots the whole card face and immediately displays the suit and the number of the poker card. Thus, the player is unable to peep at the playing card slowly with excitement.

2. It is necessary to provide an illumination light at where the poker card and the video camera are located. The illumination light consumes power and occupies space. Accordingly, the inventor of the present invention has devoted himself based on his many years of practical experiences to solve these problems.

SUMMARY OF THE PRESENT INVENTION

The primary object of the present invention is to solve the aforesaid problems and to provide a peep device for a poker card game machine. The peep device can slowly display the suit and the number of a poker card for the player to peep at the playing card with excitement and to know the suit and the number of the playing card clearly.

In order to achieve the aforesaid object, the peep device of present invention comprises a box which has accommodating troughs therein, first and second video cameras mounted in the accommodating troughs, and a reflector on top of the box. The reflector has first and second sight holes corresponding in position to the first and second video cameras. The inner walls of the box are provided with circuit boards having light emitting diodes for fill-in light. When a poker card slowly passes through the first video camera and the first sight hole, the first video camera slowly shoots and displays the suit of the poker card. When the poker card continuously passes through the second video camera and the second sight hole, the suit and the number of the poker card are displayed completely. The light emitting diodes illuminate for the first and second video cameras to shoot the poker card clearly.

Preferably, the bottom surface of the reflector is provided with engaging ribs corresponding to two sides of the first sight hole. The engaging ribs are mounted with an adjustment plate. The adjustment plate is adapted to adjust the diameter of the first sight hole.

DETAILED DESCRIPTION OF THE PREFERRED EMBODIMENT

Figure 1:
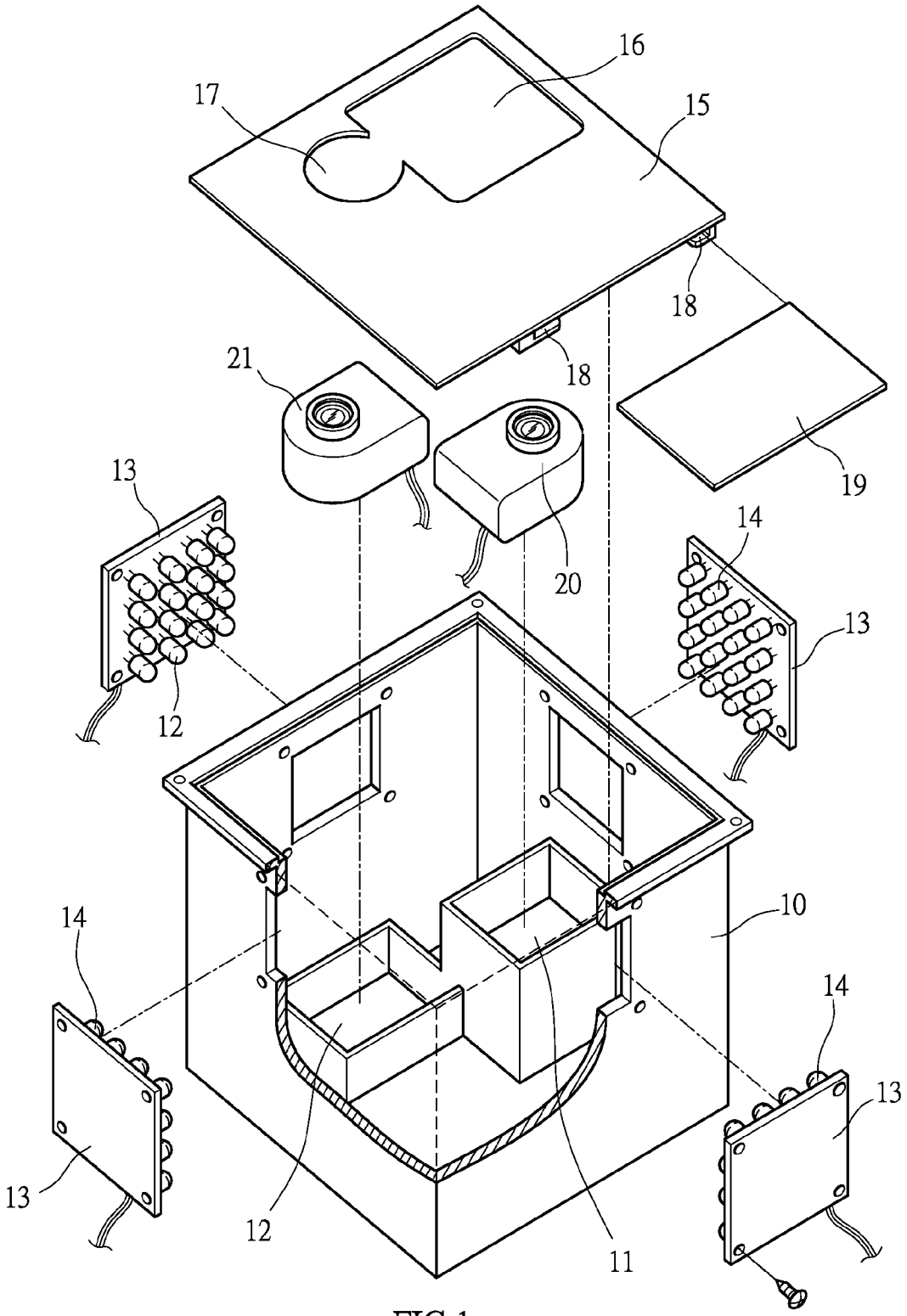
FIG. 1 is an exploded view according to a preferred embodiment of the present invention.

Embodiments of the present invention will now be described, by way of example only, with reference to the accompanying drawings.

The present invention discloses a peep device for a poker card game machine. The peep device comprises a box which has accommodating troughs therein, first and second video cameras mounted in the accommodating troughs, and a reflector on top of the box. The reflector has first and second sight holes corresponding in position to the first and second video cameras. The inner walls of the box are provided with circuit boards having light emitting diodes for fill-in light. When a poker card slowly passes through the first video camera and the first sight hole, the first video camera slowly shoots and displays the suit of the poker card. When the poker card continuously passes through the second video camera and the second sight hole, the suit and the number of the poker card are displayed completely. The light emitting diodes illuminate for the first and second video cameras to shoot the poker card clearly. The bottom surface of the reflector is provided with engaging ribs corresponding to two sides of the first sight hole. The engaging ribs are mounted with an adjustment plate. The adjustment plate is adapted to adjust the diameter of the first sight hole.

Referring to FIG. 1 to FIG. 6, the present invention comprises a box 10. The box 10 has accommodating troughs 11, 12 therein, first and second video cameras 20, 21 mounted in the accommodating troughs 11, 12, and a reflector on top of the box 10. The reflector 15 has first and second sight holes 16, 17 corresponding in position to the first and second video cameras 20, 21. The inner walls of the box 10 are provided with circuit boards 13 having light emitting diodes 14 for fill-in light. The bottom surface of the reflector 15 is provided with engaging ribs 18 corresponding to two sides of the first sight hole 16. The engaging ribs 18 are mounted with an adjustment plate 19. The adjustment plate 19 is adapted to adjust the diameter of the first sight hole 16.

Figure 2:
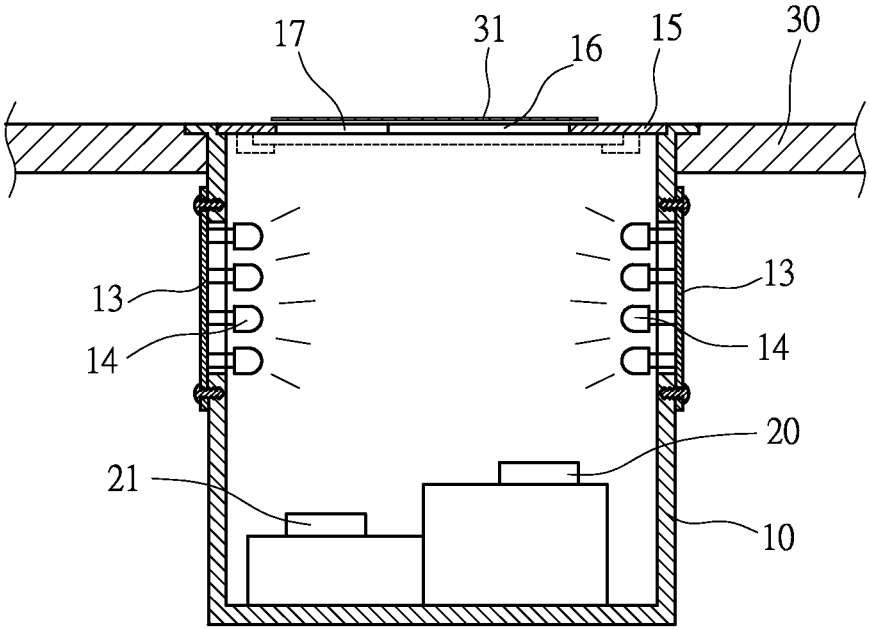
FIG. 2 is a front sectional view according to the preferred embodiment of the present invention.
Figure 3:
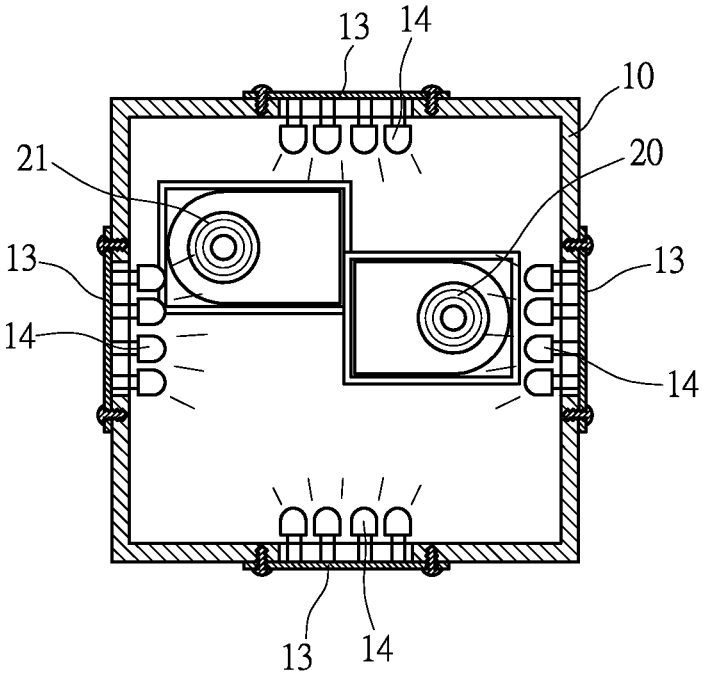
FIG. 3 is a side sectional view according to the preferred embodiment of the present invention.
Figure 4:
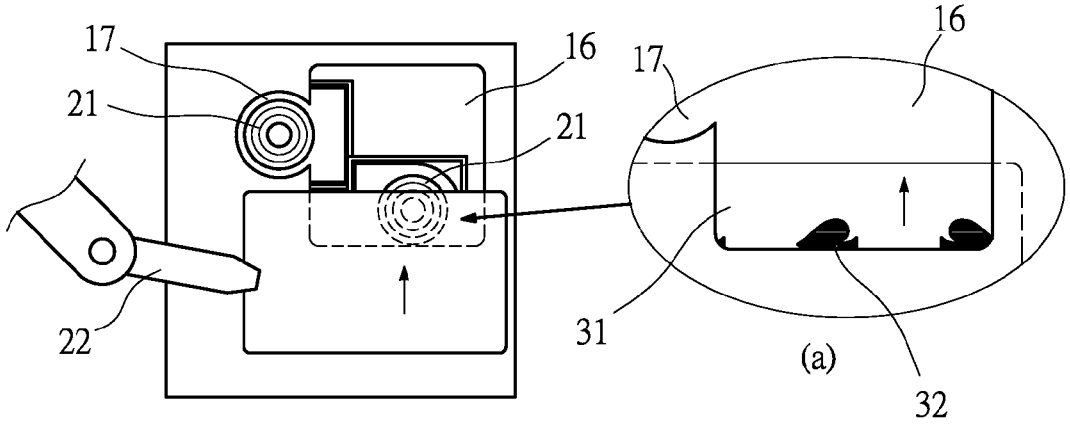
FIG. 4 is a schematic view showing that the joker card is under the first video camera state.
Figure 5:
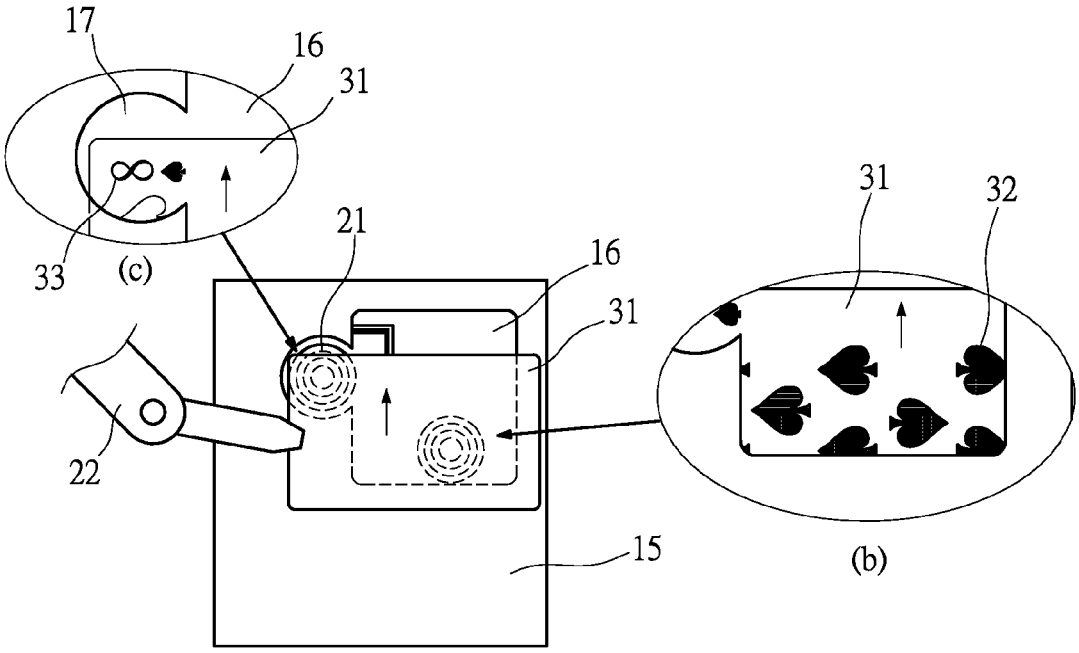
FIG. 5 is a schematic view showing that the joker card is under the second video camera state.

As shown in FIG. 2, FIG. 3, and FIG. 4, the present invention is mounted on a machine table 30 of a card game machine having a robotic arm 22 to catch poker cards. When the robotic arm 22 catches a poker card 31 to deal, the poker card 31 will slowly pass through the first sight hole 16 and the first video camera 21, as shown in FIG. 4 and (*a*). The first video camera 20 first shoots the suit 32 of the poker card 31 and shows it on the screen for the player. Only a small portion of the suit 32 is slowly exposed for the player to peep at the poker card with excitement. When the poker card 31 continuously passes through the first sight hole 16 and reaches the second sight hole 17 as shown in FIG. 5, (*b*) and (*c*), the first video camera 20 shoots most of the card face (as shown in FIG. 5 (*b*)), and the second video camera 21 shoots the number 33 of the poker 31 (as shown in FIG. 5 (*c*)). That is, the suit 32 and the number 33 of the poker card 31 are displayed completely.

Furthermore, the inner walls of the box 10 are provided with the circuit boards 13 having the light emitting diodes 14 for fill-in light. When the first and second video cameras 20, 21 are activated, the light emitting diodes 14 will illuminate. This provides the following effects and advantages:

1. Though the first and second video cameras 20, 21 don't have light in the box 10, the light emitting diodes 14 are adapted for fill-in light to shoot the poker card clearly.

2. The light emitting diodes 14 save power and are compact, so the size of the box 10 is small.

3. The first and second video cameras 20, 21 are disposed in the box 10, providing dustproof and protection effects.

Figure 6:
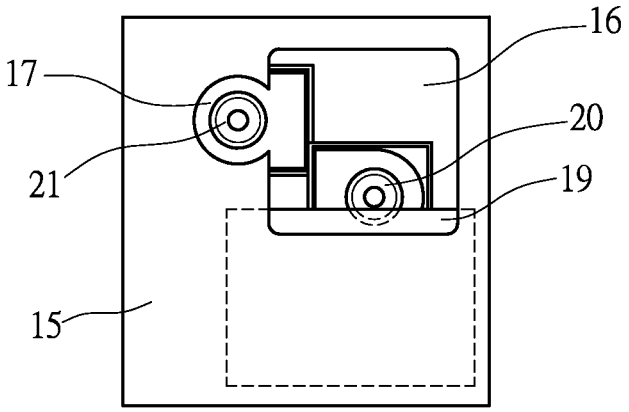
FIG. 6 is a schematic view showing that the first sight hole can be adjusted.

In addition, the effect of the adjustment plate 19 of the present invention is described hereinafter. As shown in FIG. 6, when different brands of video cameras are used, the adjustment plate 19 is adjustable. Different brands of video cameras have different focal lengths and periscopic specifications. Therefore, for the first video camera 20 not to shoot most of the poker card face initially, the adjustment plate 19 to cover the diameter of the first sight hole 16 can be adjusted and set. That is to say, the diameter of the first sight hole 16 can be adjusted according to different video cameras, so that only a small portion of the card face is shot initially for the player to peep at the poker card with excitement.

Although particular embodiments of the present invention have been described in detail for purposes of illustration, various modifications and enhancements may be made without departing from the spirit and scope of the present invention. Accordingly, the present invention is not to be limited except as by the appended claims.

What is claimed is:

1. A peep device for a poker card game machine, comprising:

a box having accommodating troughs therein;

a plurality of light emitting diodes provided at inner walls of the box for fill-in light therein;

first and second video cameras mounted in the accommodating troughs and protected in the box in a dustproof manner; and a reflector, which is provided on top of the box above the first and second video cameras for a poker card slowly moving on the reflector, having first and second sight holes corresponding in position to the first and second video cameras, wherein the first video camera and the second video camera are arranged for shooting different areas of the poker card through the first and second sight holes when the poker card is moved on the reflector, wherein the first video camera is arranged for initially shooting a suit of only a small portion of a suit of the poker card when the poker card moves along the reflector and slowly passes through the first sight hole so as to hide a number of the poker card by the reflector, wherein the first video camera is arranged for shooting the suit of the poker card when the poker card continuously passes through the first sight hole and reaches the second sight hole, wherein the second video camera is arranged for shooting the number of the poker card when the poker card passes through the second sight hole, such that the first video camera and the second video camera shoots the suit and the number of the poker card to be displayed completely.

2. The peek device, as recited in claim 1, further comprising an adjustment plate coupled underneath the reflector, wherein a bottom surface of the reflector is provided with engaging ribs corresponding to two sides of the first sight hole, the engaging ribs are mounted with the adjustment plate, and the adjustment plate adjusts a diameter of the first sight hole.

3. The peek device, as recited in claim 1, further comprising a robotic arm for dealing the poker card, wherein the robotic arm catches and moves the poker card on the reflector to slowly pass from the first sight hole to the second sight hole.

4. The peek device, as recited in claim 2, further comprising a robotic arm for dealing the poker card, wherein the robotic arm catches and moves the poker card on the reflector to slowly pass from the first sight hole to the second sight hole.

* * * * *